US005078565A

United States Patent [19]

Fritschi et al.

[11] Patent Number: 5,078,565

[45] Date of Patent: Jan. 7, 1992

[54] CONVEYING SYSTEM FOR BOBBINS

[75] Inventors: Isidor Fritschi, Andelfingen; Robert Gnos, Rickenbach, both of Switzerland

[73] Assignee: Rieter Machine Works, Ltd., Winterthur, Switzerland

[21] Appl. No.: 643,160

[22] Filed: Jan. 18, 1991

Related U.S. Application Data

[63] Continuation of Ser. No. 359,725, May 31, 1989, abandoned.

[30] Foreign Application Priority Data

May 31, 1988 [CH] Switzerland ..... 02068/88

[51] Int. Cl.[5] ..... B65H 67/04

[52] U.S. Cl. ..... 414/331; 198/465.1; 242/35.5 A; 414/401; 414/911

[58] Field of Search ..... 414/331, 911, 392, 395, 414/396, 400, 401; 198/429, 430, 447, 418.5, 465.1; 242/35.5 A

[56] References Cited

U.S. PATENT DOCUMENTS

| | | | |
|---|---|---|---|
| 2,822,910 | 2/1958 | Wachsmuth | 198/430 |
| 3,724,639 | 4/1973 | Hara | 198/430 |
| 4,144,961 | 3/1979 | Kasahara et al. | 198/465.1 |
| 4,396,355 | 8/1983 | Brandstetter et al. | 414/911 X |
| 4,548,029 | 10/1985 | Araki | 57/267 |
| 4,628,665 | 12/1986 | Herrington | 198/447 X |
| 4,723,885 | 2/1988 | Grube et al. | 414/331 |
| 4,810,155 | 3/1989 | D'Agnolo | 414/331 |
| 4,846,414 | 7/1989 | Rohner et al. | 242/35.5 A |

FOREIGN PATENT DOCUMENTS

| | | | |
|---|---|---|---|
| 2656811 | 6/1978 | Fed. Rep. of Germany . | |
| 3433706 | 5/1985 | Fed. Rep. of Germany . | |
| 3609071 | 9/1986 | Fed. Rep. of Germany . | |
| 3734397 | 4/1989 | Fed. Rep. of Germany | 414/911 |
| 2405020 | 6/1979 | France | 414/331 |

*Primary Examiner*—David A. Bucci
*Attorney, Agent, or Firm*—Kenyon & Kenyon

[57] ABSTRACT

The conveying system uses a movable trolley containing vertically spaced support surfaces, each of which has parallel tracks for receiving peg trays. The trolley is movable onto a transferring conveyor, for example, at the end of a ring spinning machine. The transfer station has conveyors for conveying rows of peg trays onto and from the trolley.

18 Claims, 3 Drawing Sheets

Fig. 3B
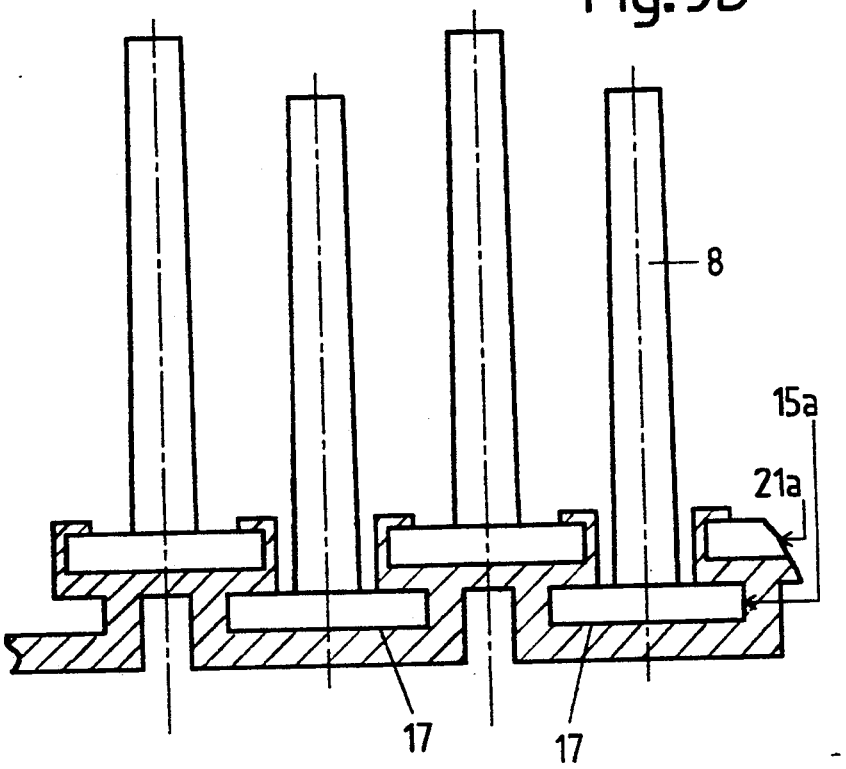
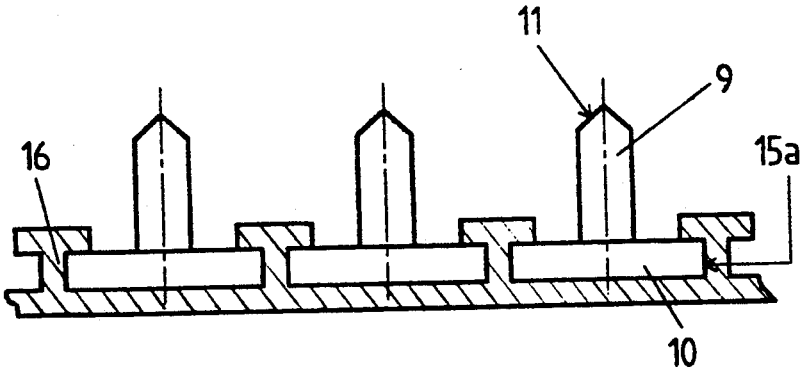
Fig. 3A

CONVEYING SYSTEM FOR BOBBINS

This application is a continuation of application Ser. No. 07/359,725, filed May 31, 1989, now abandoned.

This invention relates to a conveying system for bobbins. More particularly, this invention relates to a conveying system for conveying bobbins or cops between ring spinning machines and winders.

As is known, various types of conveying systems have been provided for conveying bobbins between ring spinning machines and winders. For example, in one known conveying system, full cops of yarn are placed on vertical pegs of individual circular discs or trays adapted to move freely on a conveying path, for example, a conveyor belt or a skid rail. These support members, which comprise pegs and trays and are known as "peg trays", are moved or conveyed with full cops from the ring spinning machine by way of one conveying path directly to the winder while identical support members containing empty cops or tubes are simultaneously moved on another conveying path from the winder to the ring spinning machine. A conveying system of this kind, known as a link system, has the advantage of standardization of the support members, and careful treatment of the cops. In addition, due to the omission of a transfer mechanism between the two textile machine systems, the passage of the cops is simplified, particularly when the ring spinning machine and the winder are close together.

However, an arrangement of this kind is sometimes impossible for structural reasons and not always desirable. For example, a conveying path between a ring spinning machine on one story of a building and a winder on another might rapidly become elaborate and lead to obstructions.

When the two machines linked together on a 1:1 basis —i.e., one ring spinning machine is linked with one winder —are close together, the disadvantage arises that the winder is exposed to the fly and heat evolved by the ring spinning machine It may also be difficult in such circumstances, to devise an effective station for damping or stilling the yarn since the yarn is processed directly in the winder.

Another disadvantage is that failure of the ring spinning machine due to a disturbance is bound to cause a stoppage of the winder. The inevitable shorter overall length of such a winder in a 1:1 link is less economic than a relatively long overall length. Since different yarn counts have to be dealt with (winder capacity must be increased, for example, for relatively course yarns), the two machines cannot be designed on a optimum capacity basis. Also, the total number of winders in a 1:1 link calls for a larger floor space.

Another known conveying system operates on the flexible link principle—i.e., cops can be moved from one ring spinning machine to various winders. This calls for transfer stations between the various systems or zones as follows. The cops must be removed from the ring spinning machine zone by the peg trays or peg belt and placed on a conveyor belt or emptied into a receptacle (the conveying zone). Quality may suffer because the horizontally conveyed cops graze lateral guides of the conveyor belt or knock and rub against one another. To reach the winder zone, the cops are discharged from the conveyor belt, possibly by way of points or switches, into vibrators which return the cops to their vertical position and place or locate them on peg trays near the winder. The route-independent receptacles can be rolled or moved to the particular winders concerned and are tilted by tilting mechanisms into the vibrators. The cops which have been emptied in the winder drop into special receptacles. These empty cops are returned to the ring spinning machine where a tube loader returns them to the peg trays or peg belt of such machine. Complex control mechanisms and buffer stations are necessary to automate a transport system which is by its nature already elaborate.

Accordingly, it is an object of the invention to provide a low-cost uncomplicated economic easy-to-maintain adaptable conveying system for bobbins which does not damage the yarn.

It is another object of the invention to provide a conveying system for conveying bobbins which utilizes a minimum of parts.

It is another object of the invention to simplify the conveying system for conveying bobbins between ring spinning machines and winders.

It is another object of the invention to provide a conveying system for bobbins which is simple to service.

It is another object of the invention to provide a conveying system for bobbins wherein yarn quality is not impaired.

Briefly, the invention provides a conveying system for bobbins which is comprised of a plurality individual freely movable support members for receiving empty bobbins (cops) and full bobbins (cops) thereon and a movable conveying element having a loading surface for receiving the bobbin support members.

The conveying element is movable independently so as to be moved from a ring spinning machine to a winder and vice versa. The conveying system is economic since the conveying element is relatively inexpensive to produce and replaces relatively expensive conveying paths and vibrators. Likewise, separate conveying facilities for conveying empty and fully cops can be eliminated along with tube loaders and control mechanisms. Accordingly, the conveying system is uncomplicated.

In this respect, standardization of the tray dimensions of the peg trays for a ring spinning machine and winder can be retained but with the further advantage that all the winders continue to operate in the event of one ring spinning machine becoming defective and the winders can now be of optimum design as regards capacity and length.

Discrete route-independent conveying elements which are adapted to move on a floor can remain in yarn-damping stations for as long as required and, unlike overhead conveyors, are simple to service, thus further reducing costs. Since the cops remain on the peg trays during conveyance between the ring spinning machines and the winders and do not contact one another, yarn quality is not impaired. Overseeability is ensured in both manual and in driverless automatic conveyance of the conveying elements. Buffer stations can be substantially obviated since the conveying elements themselves are effective as a buffer. Subsequent extensions of the spinning works are simple and uncomplicated to implement.

The loading surface of the conveying element may also be subdivided into a plurality of parallel tracks with each track having a width equal to a width of a respective support member. This enables the loading surface to be constructed in an economic manner. Also, all the cops produced by a ring spinning machine and placed on support members or all the support members to be delivered to a ring spinning machine can be effected in a single transfer operation.

The conveying system also includes a transfer station for receiving the conveying element therein. The transfer station includes a first conveying means for conveying a plurality of support members to the conveying element and a second conveying means for conveying a plurality of support elements from the conveying element. One advantage of the transfer station is that the two conveying means need not be duplicated for every conveying element. That is, the transfer station is provided with the conveying means rather than each individual conveying element being provided with means for conveying the support members into and out of the conveying element. This results in reduced costs.

The transfer station may also be provided with a slider for conveying a row of support members from the first conveying means transversely into the tracks of the conveying elements. The slider may also be used to convey a row of support member from the conveying element transversely onto the second conveying means of the transfer station. This allows the conveying element to be loaded and unloaded simultaneously in an economic manner.

The first conveying means of the transfer station may be in form of an endless conveyor belt having a plurality of spaced apart spaces, each of which is of a thickness equal to the distance between two tracks of the transfer element. Thus, the spacers serve to align the support members on the conveyor in registration with the tracks of the conveying elements.

The conveying element which may be in the form of a trolley includes a plurality of vertically spaced horizontal support surfaces for receiving rows of bobbins. The spacing between the support surfaces is such as to accommodate the overall height of a support member with a cop thereon. In this respect, the conveying means of the transfer station are vertically adjustable as a whole. Further, the tracks of each support surface may be alternately disposed in two vertically spaced horizontal planes with a closer centerline to centerline spacing of the support members so as to increase the capacity of each support surface.

These and other objects and advantages of the invention will become more apparent from the following detailed description taken in conjunction with the accompanying drawings wherein:

FIG. 3A illustrates a partial sectional view taken on line III—III of FIG. 1 of a support surface in accordance with the invention; and FIG. 3B illustrates a view similar to FIG. 3A of a modified support surface in accordance with the invention;

Figure 1:
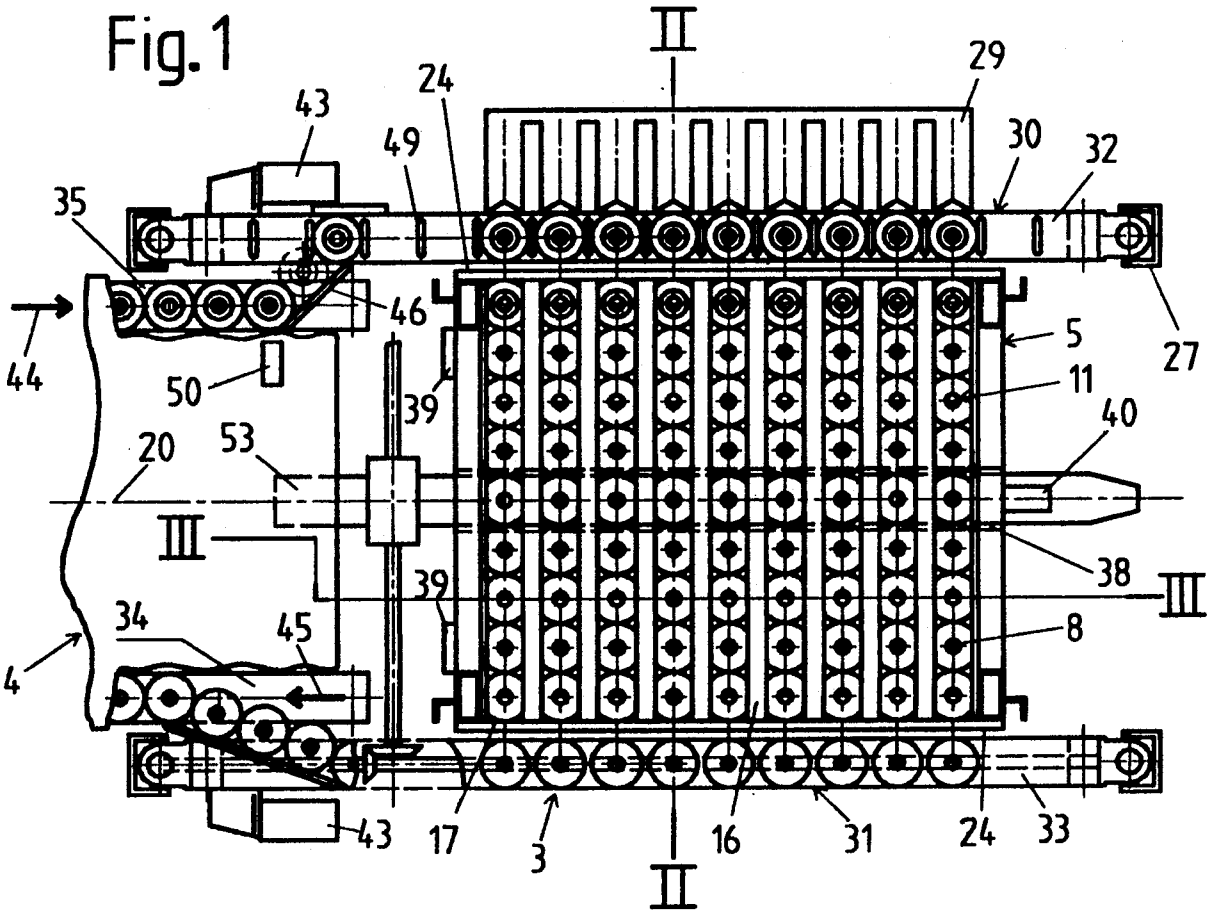
FIG. 1 illustrates a diagrammatic plan view of a transfer station and a conveying element constructed in accordance with the invention.

Referring to FIG. 1, the conveying system for bobbins employs a stationary transfer station 3 which is incorporated at one end of a textile machine, which in the case shown, is a ring spinning machine 4. In addition, the system employs a conveying element 5, in the form of a cop trolley or roll-on-roll-off trolley which has been moved into the transfer station 3 from a winder (not shown).

The conveying system also employs a plurality of individual freely movable support members in the form of peg trays 11. As indicated in FIG. 3A, each peg tray 11 includes a single peg 9 and a circular disk or tray 10. The number of peg trays 11 corresponds to the number of spinning stations of the ring spinning machine 4. The trolley 5 is loaded with empty cops 8, each of which is disposed on the vertical pegs 9 of the support members 11. The trolley can be moved as required on rollers 14 to any textile machine and is therefore route-independent. Further, the trolley can be conveyed by a fork lift truck and has, for example, four horizontal vertically spaced apart support surfaces 15*a*–15*d* (see FIG. 2).

Each loading or support surface 15 is subdivided into a plurality of parallel tracks 17 (see FIG. 3B) each of which has a width substantially equal to the width of a disk 10 of a respective support for slidably receiving the individual discs 10 member 11. As indicated in FIG. 3A, the parallel tracks 17 are separated by bars or rails 16 and extend parallel to one another and transversely of the longitudinal axis 20 (see FIG. 1) of the ring spinning machine 4. The total loading surface is distributed between the four loading surfaces 15*a*–15*d* which are separated from one another substantially by the overall height of a support member 11 with a cop 8 thereon.

As indicated in FIG. 1, all the tracks 17 of each loading surface are filled with support members 11. The capacity of the loading surfaces of the trolley 5 can be determined or adapted to the existing spinning plant by a longitudinal alteration, as considered in the direction of the axis 20, and by additional loading surfaces 15.

Referring to FIG. 3B, in order to make better use of the volume of the trolley 5 and, more particularly, the space between the cops 8, the tracks 17 are alternately disposed in two vertically spaced horizontal planes 15*a*, 21*a*. In addition, the rails 16 are modified to accommodate the offset relationship of the alternating tracks. As indicated, the vertical distance between the two rows of tracks corresponds substantially to the height of a disk 10.

Figure 2:
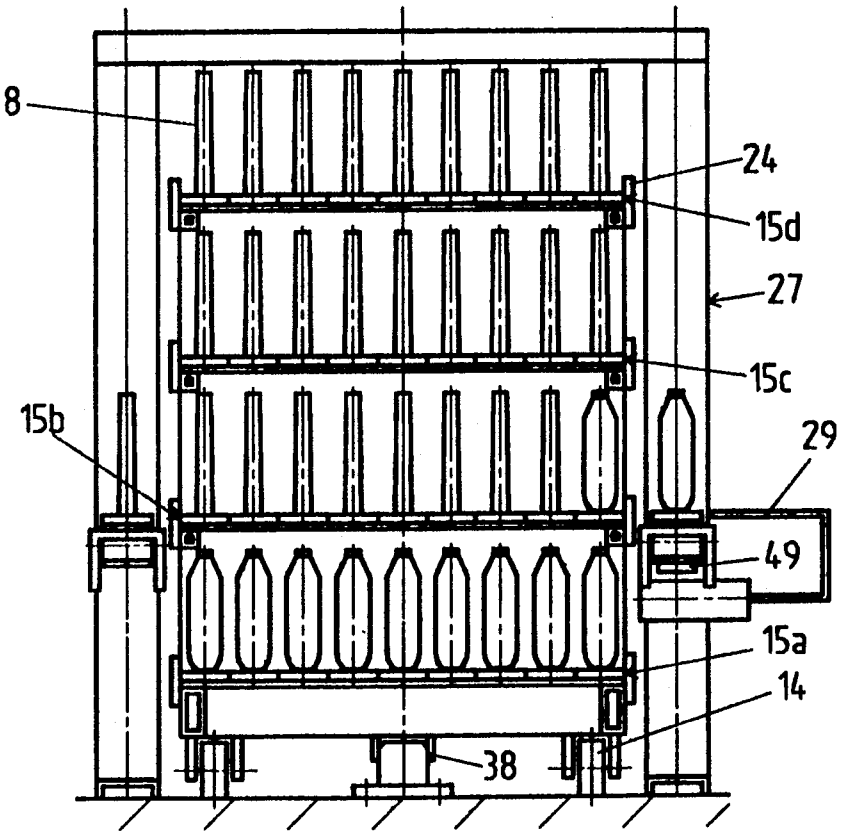
FIG. 2 illustrates a view taken on line II—II of FIG. 1.

Referring to FIG. 2, each longitudinal side of the loading surface of the support trolley 5 is provided with a removable barrier 24 for closing the tracks 17 in order to contain the support members 11 therein. This ensures that the no support member 11 can drop out while the trolley 5 is moved.

Referring to FIG. 2, the transfer station 3 also has a gantry 27 in which a pair of conveying means in the form of conveyors 30, 31 are provided along with a slider 29. As indicated in FIG. 1, the conveyors 30, 31 are disposed in parallel in order to receive the trolley 5 therebetween. In addition, the conveyors 30, 31 and slider 29 are disposed for vertical adjustment on the gantry 27 so that the top runs of endless belts 32, 33 of the conveyors 30, 31 can be aligned to register horizontally with the tracks of the respective loading surfaces 15 of the trolley 5. In addition, as indicated in FIG. 1, the conveyor belts 32, 33 extend parallel to and over a transition zone along the sides of the ring spinning machine 4 and, particularly, outside internal conveyors 34, 35 of the machine 4,. In this respect, the conveyors 34, 35 form a single conveying path which extends to around the other end of the spinning machine 4. These conveyors 34, 35 serve to carry the support members thereon.

The belts 32, 33 are each driven by a motor 43 (see FIG. 1). One conveyor 35 of the ring spinning machine 4 cooperates with an inclined guide 46 in a transition path to the belt 32 for conveying support members with full bobbin cops thereon from the machine 4. The other conveyor 34 cooperates with a similar inclined guide with the conveyor 31 in order to convey support members with empty bobbin cops from the transfer station 3 into the machine 4.

As shown in FIG. 1, the conveyor 30 is provided with a plurality of spaced apart spacers 49 each of which is of a thickness equal to the distance between two tracks 17, for example, corresponding to the thickness of a rail 16.

The trolley 5 can be positioned in the transfer station 3 by means of deflectors 38 of the trolley and by means of stops 39 and a lock 40 of the transfer station 3.

In an initial position, the loading surfaces of the conveyor belts 32, 33 are horizontally flush with those of the conveyors 34, 35 of the machine 4. During operation, the conveyor 35 and the belt 32 are driven in the direction indicated by the arrow 44 to the right, as viewed in FIG. 1. The belt 33 and the conveyor 35 are moved to the left, as indicated by the arrow 45. The support members 11 with full bobbin cops are therefore moved to the right from the machine 4 along the inclined guide 46 in the transition path to the belt 32. After a counter 50 has determined that the number of cops of a first row is correct, the conveyors 34, 35 and the belts 32, 33 are stopped and, after the barriers 24 of the aligned loading surface have been pivoted or lowered, the slider 29 is actuated. In this position, in which the spacers 49 are accurately aligned with the rails 16, the slider 29 pushes the first row of support members 11 onto the tracks of the trolley 5 so that another row of support elements 11 with empty cops 8, disposed on the opposite side of the trolley 5 is pushed or slid off the trolley 5 onto the belt 33. The slider 29, thus operates in a pusher mode. If there no entraining spacers on the belt 33, elongate removable guides must be provided along the belt 33 to prevent the support members 11 from falling off. Guides of this kind can also be associated with the belt 32.

Thereafter, the belts 32, 33 and the conveyors 34, 35 are restarted so that the support members 11 with the full bobbins and the support members 11 with the empty cops 8 are conveyed in different directions. The trolley 5 is therefore loaded and unloaded simultaneously.

When the tracks 17 of the main loading surface 15*a* have been loaded with full cops, a vertical adjustment motor 53 (see FIG. 1) is actuated so as to rotate four vertical screw threaded spindles of the gantry 27 which serve to move the conveyors 30, 31 and slider 29 vertically. The support members 11 which are on the conveyors 30, 31 are also moved to the next loading surface, or in the case of an embodiment as illustrated in FIG. 3B to the next level of track.

The barriers 24 may be pivoted away by a suitable mechanical pushing device (not shown) when all the conveyors 30, 31 of the transfer station 3 come near a loading surface.

Referring to FIG. 1, the slider 29 is actuated by any suitable control means (not shown) of the transfer station 3 in order to be actuated after the counter 50 indicates that the appropriate number of support members 11 have passed onto the conveyor 30 and are positioned in alignment with the respective track 17 of a loading surface. As indicated in FIG. 2, the slider 29 has a surface aligned with the discs 10 of the support members 11 for pushing of the disks into the respective tracks of the trolley 5.

After a trolley 5 has been fully loaded with full bobbins, the lock 40 can be released in a manner not shown and the trolley 5 rolled out of the transfer station 3, for example directly to a transfer station 3 of a winder for unloading of the full bobbins and for loading of support members 11 with empty cops 8 thereon. The trolley 5 can then be returned to the transfer station 3 of the ring spinning machine 4 or to another ring spinning machine (not shown).

The invention thus provides a conveying system which is of relatively simple and economic construction.

In addition, the invention provides a conveying system whereby a ring spinning machine wherein full bobbins can be unloaded an empty bobbin cops loaded in a simultaneous manner.

The invention also provides a trolley which can be loaded with peg trays and moved in a route-independent manner between ring spinning machines and winders.

What is claimed is:

1. A conveying system for bobbins comprising a plurality of individual freely movable support members, each said member having a single peg for receiving a bobbin and a circular disc supporting said peg thereon;

a route independent movable conveying element having a loading surface for individually receiving said bobbin support members, said loading surface being subdivided into a plurality of parallel tracks, each said track having a width for slidably receiving said disc of a respective support member; and a transfer station for receiving said conveying element therein, said station including first conveying means for conveying a plurality of support members with full bobbins to said conveying element and second conveying means for conveying a plurality of support elements with empty bobbins from said conveying element.

2. A system as set forth in claim 1 wherein said tracks are alternately disposed in two vertically spaced horizontal planes and each said conveying means is vertically adjustable.

3. A system as set forth in claim 2 wherein said planes are vertically spaced a distance substantially equal to a height of said disc of a respective support member.

4. A system as set forth in claim 1 wherein said transfer station includes a slider for conveying a row of support members from said first conveying means transversely from said first conveying means into said tracks of said conveying element and for conveying a row of support members from said conveying element transversely onto said second conveying means.

5. A system as set forth in claim 4 wherein said first conveying means includes an endless conveyor belt having a plurality of spaced apart spacers, each spacer being of a thickness equal to the distance between two of said tracks.

6. A system as set forth in claim 4 wherein said first and second conveying means are disposed in parallel.

7. A system as set forth in claim 4 which further comprises removable barriers for closing said tracks alongside said conveying element to contain said support members therein.

8. A conveying system for conveying bobbins between ring spinning machines and winders, said system comprising a route independent movable trolley having a plurality of vertically spaced horizontal support surfaces for receiving rows of bobbins, each said support surface including a plurality of parallel tracks;

a plurality of support members slidably mounted in said tracks, each said support member having a single peg for receiving a bobbin thereon; and a transfer station for mounting at one end of a spinning machine, said station including first conveying means for sequentially conveying rows of said support members transversely into said tracks of a selected one of said support surfaces, a slider for pushing a row of support members from said first conveying means into said tracks and second conveying means for sequentially receiving and conveying rows of support members from at least one of said support surfaces

9. A conveying system as set forth in claim 8 wherein said transfer station includes a gantry having said first conveying means, said second conveying means and said slider vertically movable therein relative to said support surfaces.

10. A conveying system as set forth in claim 8 further comprises removable barriers for closing said tracks alongside said trolley.

11. In combination, a ring spinning machine;

a plurality of individual freely movable support members;

a first conveyor for conveying support members with full cops thereon from said machine;

a second conveyor for conveying support members with empty cops thereon to said machine;

a transfer station mounted at one end of said machine, said station having a third conveyor for receiving support members with full cops from said first conveyor and a fourth conveyor parallel to said third conveyor for delivering support members with empty cops to said second conveyor; and a movable trolley for movement into and between said conveyors of said transfer station, said trolley having at least one horizontal support surface including a plurality of parallel tracks for slidably receiving support members therein.

12. The combination as set forth in claim 11 wherein said transfer station includes a slider for pushing a row of support members from said third conveyor into said tracks.

13. The combination as set forth in claim 12 wherein said trolley includes a plurality of said support surfaces disposed in vertically spaced relation.

14. The combination as set forth in claim 13 wherein said transfer station includes a gantry having said third conveyor, said fourth conveyor and said slider vertically movable thereon relative to said support surfaces.

15. The combination as set forth in claim 14 wherein said tracks of each support surface are alternately disposed in two vertically spaced horizontal planes.

16. A conveying system for conveying bobbins between ring spinning machines and winders, said system comprising a movable trolley having a plurality of vertically spaced horizontal support surfaces for receiving rows of bobbins, each said support surface including a plurality of parallel tracks;

a plurality of support members slidably mounted in said tracks, each said support member having a peg for receiving a bobbin thereon; and a transfer station for mounting at one end of a spinning machine, said station including first conveying means for sequentially conveying rows of said support members transversely into said tracks of a selected one of said support surfaces; and second conveying means for sequentially receiving and conveying rows of support members from at least one of said support surfaces.

17. A conveying system as set forth in claim 16 wherein said tracks are alternately disposed in two vertically spaced horizontal planes and each said conveying means is vertically adjustable.

18. A conveying system as set forth in claim 16 wherein said transfer station includes a slider for conveying a row of support members transversely from said first conveying means into said tracks of said conveying element and for conveying a row of support members from said conveying element transversely onto said second conveying means.

* * * * *